US006138795A

United States Patent [19]

Kamiya

[11] Patent Number: 6,138,795

[45] Date of Patent: Oct. 31, 2000

[54] POSITION DETECTOR FOR INDUSTRIAL VEHICLES

[75] Inventor: Toshikazu Kamiya, Kariya, Japan

[73] Assignee: Kabushiki Kaisha Toyoda Jidoshokki Seisakusho, Kariya, Japan

[21] Appl. No.: 09/267,317

[22] Filed: Mar. 12, 1999

[30] Foreign Application Priority Data

Mar. 18, 1998 [JP] Japan ..... 10-068471

[51] Int. Cl.[7] ..... B66F 9/20

[52] U.S. Cl. ..... 187/223; 187/224

[58] Field of Search ..... 187/222, 223, 187/224; 414/630, 631, 636, 634

[56] References Cited

U.S. PATENT DOCUMENTS

| | | | |
|---|---|---|---|
| 4,231,450 | 11/1980 | Hedke et al. | 187/9 R |
| 4,265,337 | 5/1981 | Dammeyer | 187/9 E |
| 4,411,582 | 10/1983 | Nakada | 414/636 |
| 4,598,797 | 7/1986 | Schultz | 187/9 R |
| 5,749,696 | 5/1998 | Johnson | 414/635 |
| 5,791,440 | 8/1998 | Lonzinski et al. | 187/223 |

FOREIGN PATENT DOCUMENTS 5-49793 6/1993 Japan .

*Primary Examiner*—Jonathan Salata
*Attorney, Agent, or Firm*—Morgan & Finnegan, L.L.P.

[57] ABSTRACT

An apparatus in a forklift for detecting the height of a fork in stages. Two sensors are arranged longitudinally on the mast. Each sensor includes a switch that has two states. The state of each switch can be changed by movement of the fork. Each switch is connected to input terminals of a controller. The signal at each input terminal changes between two levels in accordance with the state of a corresponding switch. A memory in the controller stores data that defines the relationship between ranges of movement of the fork, or zones, and the combination of the signals. The controller judges the height of the fork when the combination of signals corresponds to a combination that exists in the data. The controller judges that there is an abnormality when the combination does not exist in the data. This permits detection of malfunctioning switches and a cut and a short-circuited wiring.

7 Claims, 5 Drawing Sheets

D1

| | $T_1$ | $T_2$ | $T_3$ |
|---|---|---|---|
| high position | H | H | L |
| middle position | H | L | H |
| low position | L | H | H |

Fig.7

D2

| | $T_1$ | $T_2$ | ••• | $T_n$ | $T_{n+1}$ |
|---|---|---|---|---|---|
| $R_{n+1}$ | H | H | ••• | H | L |
| $R_n$ | H | H | ••• | L | H |
| ⋮ | ⋮ | ⋮ | ⋮ | ⋮ | ⋮ |
| $R_2$ | H | L | ••• | H | H |
| $R_1$ | L | H | ••• | H | H |

D3

| | $T_1$ | $T_2$ | $T_3$ | $T_4$ |
|---|---|---|---|---|
| high position | L | H | L | H |
| middle position | L | H | H | L |
| low position | H | L | H | L |

POSITION DETECTOR FOR INDUSTRIAL VEHICLES

BACKGROUND OF THE INVENTION

The present invention relates to a detector for detecting the position of forks in industrial vehicles such as forklifts. More specifically, the present invention pertains to a technology for detecting abnormalities in wires that transmit position detection signals.

In industrial vehicles such as forklifts, a pair of inner masts is supported in a pair of outer masts. The inner masts slide up and down in the outer masts and a fork moves with the inner masts. In such forklifts, various controls are performed in accordance with the position of the fork. For example, the fork may be automatically stopped at a position set in advance. The rear axle is pivotally supported for improved driving performance. When the fork is raised high and the center of gravity of the vehicle is high, the pivoting movement of the rear axle is restricted to improve stability.

Generally, a reel-type sensor is used to continuously detect the height of fork. The reel-type sensor detects the rotation of a reel, which winds and unwinds a wire in accordance with the movement of the fork, to determine the fork height. Alternatively, switch-type sensors may be used to intermittently detect the height of the fork. A plurality of switch-type detectors is installed on the outer masts, spaced at a certain distance from one another. A dog is attached to the inner masts to actuate the switches. The number of detectors turned on in accordance with the height of the inner masts changes. Accordingly, the height of forklift is intermittently detected based on the on-off state of the detectors.

Whether to continuously detect or intermittently detect the fork height is determined by the kind of control performed. For example, detecting only three height zones, that is, a lower zone, a middle zone, and a high zone may be sufficient. In this case, an inexpensive switch-type sensor is preferred over a more costly reel-type sensor.

When switch-type detectors are used, a plurality of switch-type detectors are arranged vertically on the outer masts with a predetermined distance from one another. Wires from each switch-type detector extend along the outer masts. However, when the wires slacken by the movement of the inner masts, the wires may be caught and cut by the inner masts. The cut wires may be short-circuited by touching the masts or the vehicle body. This is likely to cause abnormalities in the electrical system.

Such abnormalities must be detected quickly. However, in prior art apparatuses that detect the height in accordance with the on-off state of the switch-type detectors, abnormalities such as a cut line and a short circuit cannot be detected. Therefore, as a safety measure, the signal input to the controller when the fork is at the highest position is made to be the same as that when there is a cut wire. In this way, when a wire is cut, the control used when the fork is at the highest position is performed. When the fork is at the highest position, the center of the gravity of the vehicle is high, which lowers the stability of the vehicle. Thus, if a wire is cut, the control procedure for stabilizing the vehicle is performed at all times.

This safety measure does not detect cut wires and is not a fully satisfactory solution. If an operator does not notice the abnormality, proper control in accordance with the fork height is not performed, which lowers the performance of the forklift.

When the number of wires extending from the switch-type detector is large, a wire is more likely to be cut. Further, a controller needs many input terminals. Therefore, it is desirable to reduce the number of wires employed with the switch-type detectors.

SUMMARY OF THE INVENTION

The objective of the present invention is to provide a position detector that detects disorders such as cut wires and short-circuit. Another objective of the present invention is to provide a position detector that has a small number of wires as possible.

To achieve the above objective, the present invention provides an apparatus for detecting the position of a movable body provided on an industrial vehicle. The movable body moves on a predetermined path, and the apparatus detects the passage of the movable body on the path. The apparatus has the following structure. The apparatus includes a switch or a plurality of switches. Each switch has two states, and each switch is associated with a location on the path. Passage of the movable body by the location changes the state of the associated switch. A position judging means having a plurality of input terminals. The number of the plurality of input terminals is more than the number of switches by at least one. Each switch is connected to at least one of the plurality of input terminals. Each of the plurality of terminals is associated with the switch or one of the switches. Signals at the input terminals have two states in accordance with the state of the associated switch. The judging means includes position judging data, wherein a relationship between zones of movement of the movable body and combinations of signal states at the input terminals is defined by the data. The judging means judges that the position of the movable body is within one of the zones in accordance with the data when the combination of the signals at the input terminal exists in the data. The judging means judges that there is an abnormality when the combination of signals at the input terminal does not exist in the judging data.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 3(*b*) is a view like FIG. 3(*a*) showing actuation of a sensor 7.

FIG. 7 is a data table showing the relationship between the fork height and the combination of signals to a controller;

DETAILED DESCRIPTION OF THE PREFERRED EMBODIMENTS

Figures 1, 2:
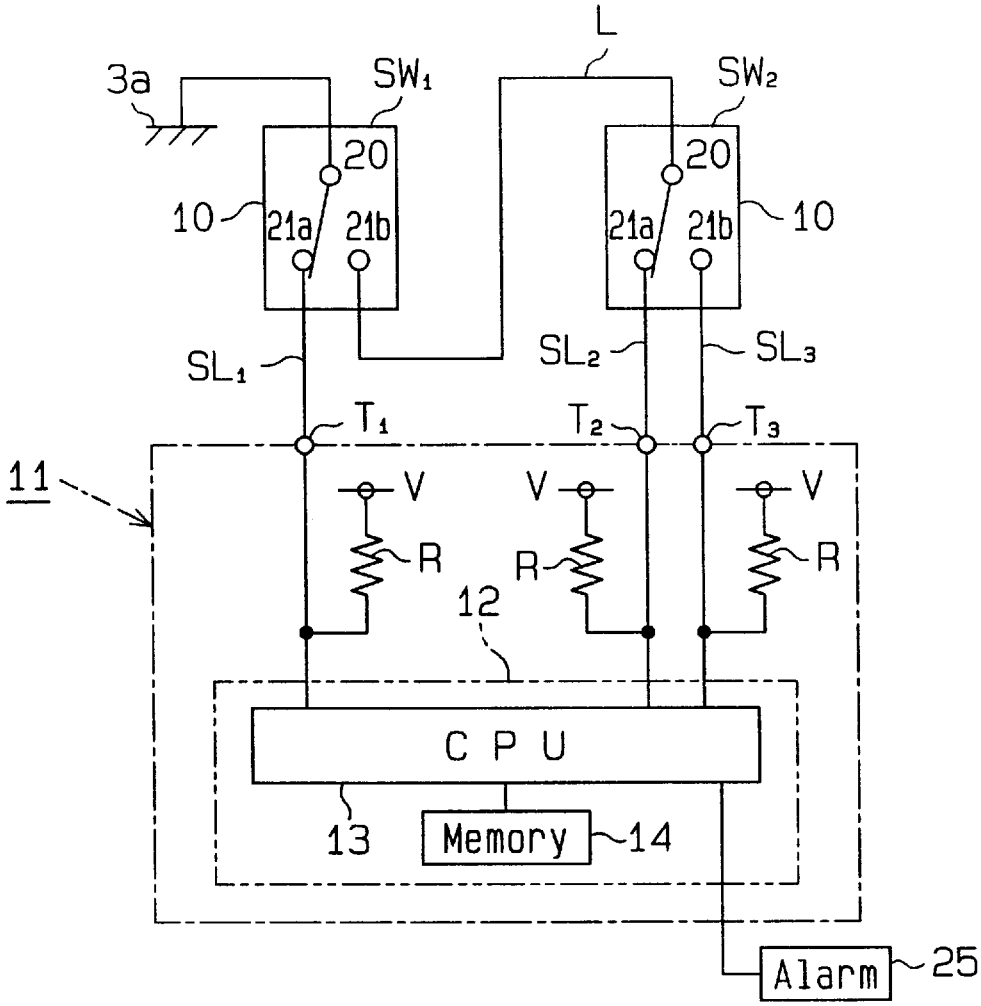
FIG. 1 is an electric circuit of a detector according to a first embodiment of the present invention.
FIG. 2 is a data table showing the relationship between the fork height and the combination of signals to a controller.

A forklift according to a first embodiment of the present invention will now be described in reference to FIGS. 1–5. As shown in FIG. 5, masts 3 are provided at the front portion of a vehicle body 2 of a forklift 1. The masts 3 include a pair of outer masts 3*a,* which are pivotally supported by the vehicle body 2, and a pair of inner masts 3*b,* which are located in the outer masts 3*a* so as to move up and down. The inner masts 3*b* are connected to the top end of a piston rod 4*a* of a lift cylinder 4. Chains (not shown) are installed to chain wheels (not shown), which are supported on the top ends of the inner masts 3*b.* A lift bracket 5, which is installed along the inner masts 3*b* to move up and down, is hung from the chains. A fork 6 for carrying loads is installed to the front side of the lift bracket 5. The expansion and contraction of the lift cylinder 4 moves the fork 6 up and down by a distance, for example, that is two times the stroke of the inner masts 3*b.*

Two height sensors 7 are installed at positions on one of the outer masts 3*a.* The sensors 7 are spaced apart and are at predetermined locations. Each sensor 7 outputs either a high level signal or a low level signal according to whether it contacts the inner mast 3*b.* Based on signals from the sensors 7, the fork is judged to be in one of three zones, that is, a low zone, a middle zone, and a high zone.

Figure 4:
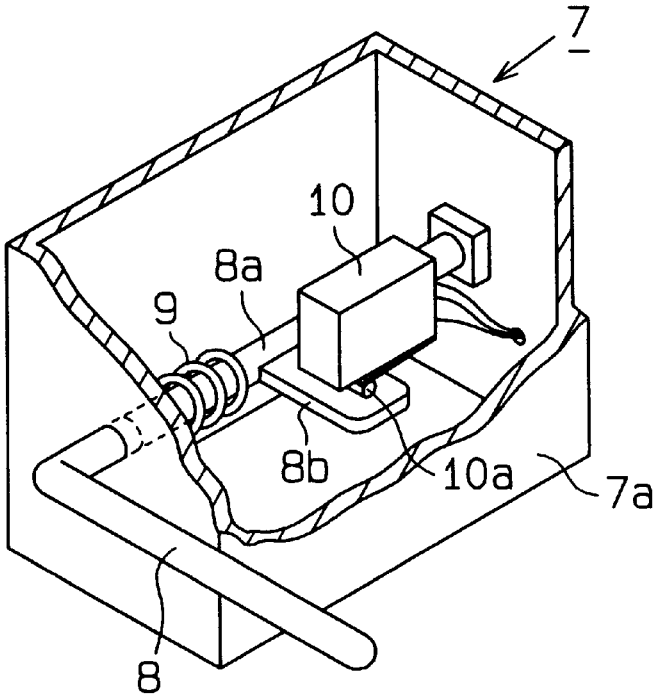
FIG. 4 is a partially cut-away perspective view of a detector according to FIG.3.
Figure 5:
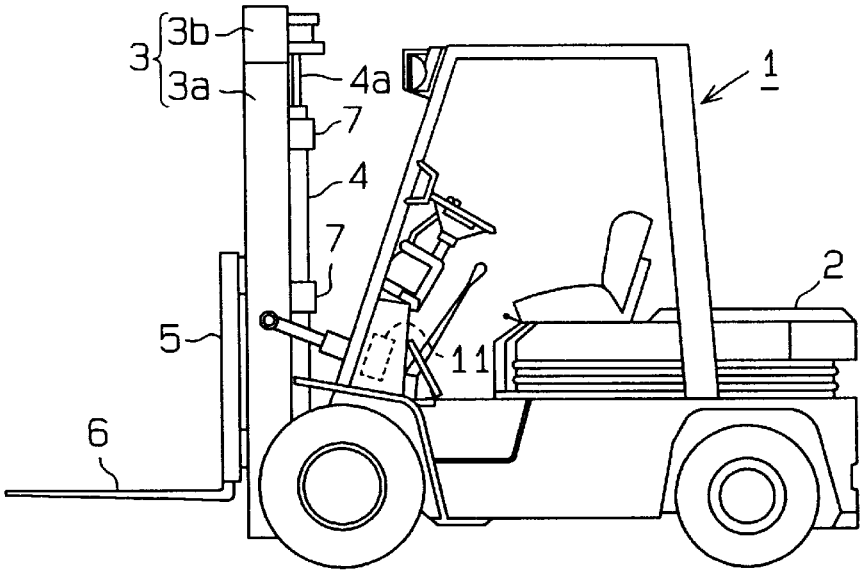
FIG. 5 is a side elevation of a forklift.

As shown in FIG. 4, each height sensor 7 includes an L shaped lever 8, which is pivotally supported in a housing 7*a.* The lever 8 is urged in one rotational direction (counterclockwise in FIG. 4) by a spring 9.

Figure 3A:
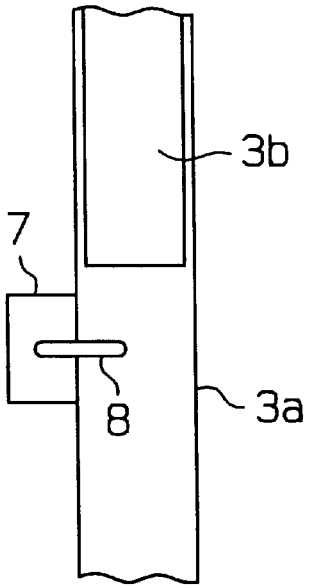
FIG. 3(*a*) is a partial side elevation view showing the detector of FIG. 1 from the inside of a mast.
Figure 3B:
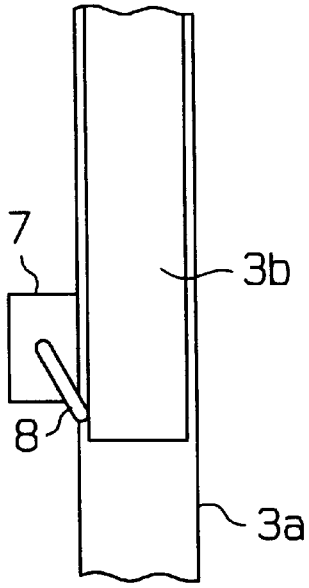

A switch 10 having a detection member 10*a* is provided in the housing 7*a.* A detection plate 8*b* extends from a shaft 8*a* of the lever 8 in the housing 7*a.* When the detection plate 8*b* abuts the detection member 10*a,* the lever 8 is prevented from pivoting further counterclockwise and is retained at a position perpendicular to the longitudinal axis of the outer mast 3*a* as shown in FIG. 3(*a*) and FIG. 4. The lever 8 can pivot clockwise in the state shown in FIG. 4.

As shown in FIGS. 3(*a*) and 3(*b*), the height sensors 7 are fixed to the rear surface of the outer mast 3*a.* The distal end of the lever 8 extends into the path of the inner mast 3*b.* Accordingly, the lever 8 is engaged by and pivoted by the inner mast 3*b.* As shown in FIG. 3(*a*), when the inner mast 3*b* is disengaged from the lever 8, the lever 8 is returned to the horizontal position of FIG. 3(*a*) by the spring 9. At this state, the detection plate 8*b* presses the detection member 10*a.* As shown in FIG. 3(*b*), when the inner mast 3*b* moves down, the mast 3*b* engages the distal end of the lever 8 and pivots the lever 8 clockwise. This disengages the detection plate 8*b* from the detection member 10*a.* In the range of motion between when the lower end of the inner mast 3*b* engages the lever 8 and when the mast moves to its lowest position, the lever 8 engages the side surface of the inner mast 3*b.* That is, the detection plate 8b is held away from the detection member 10*a.*

The switches 10 are contact-type detectors. Each switch is electrically connected to a controller 11 (See FIG. 1), which is located in the vehicle body 2.

FIG. 1 shows an electrical circuit of the position detector. Each switch 10 includes a terminal 20 and first and second contact points 21*a,* 21*b,* which are selectively connected to the terminal 20. For convenience, the switch 10 of the lower sensor is referred to as a lower switch $SW_1$, and the switch 10 of the upper sensor is referred to as an upper switch $SW_2$.

The terminal 20 of the lower switch $SW_1$ is grounded to the outer mast 3*a.* The first contact point 21*a* of the lower switch $SW_1$ is connected to a first input terminal $T_1$ of the controller 11 by a first signal line $SL_1$. The second contact point 21*b* of the lower switch $SW_1$is connected to the terminal 20 of the upper switch $SW_2$ by a connecting line L. The first contact point 21*a* of the upper switch $SW_2$ is connected to the second input terminal $T_2$ Of the controller 11 by a second signal line $SL_2$. The second contact point 21*b* of the upper switch $SW_2$ is connected to a third input terminal $T_3$ of the controller 11 by a third signal line $SL_3$.

The controller 11 includes a computer 12 including a central processing unit (CPU) 13 and a memory 14. A source voltage V is applied between each input terminal $T_1$–$T_3$ and the CPU 13 through resistors R.

The upper and lower switches $SW_1$, $SW_2$ selectively ground one of signal lines $SL_1$–$SL_3$, which are connected the input terminals $T_1$–$T_3$, respectively, to the outer mast 3*a.* When a signal line $SL_1$–$SL_3$ is not grounded, the source voltage V is applied to the corresponding input terminal $T_1$–$T_3$ through a corresponding resistor R, and the potential at the corresponding input terminal $T_1$–$T_3$ is positive. When a signal line $SL_1$–$SL_3$ is grounded to the outer mast 3*a,* current flows to the outer mast 3*a* and the potential at the corresponding input terminal $T_1$–$T_3$ becomes substantially zero. The CPU 13 detects the changes of potential in each input terminal $T_1$–$T_3$ as the input signal level changes. In other words, the CPU 13 receives a high level or a low level signal through each input terminal $T_1$–$T_3$, in accordance with the potential at each input terminal $T_1$–$T_3$.

As shown in FIG. 2, the memory 14 stores data D1 that determines the relationship between the height of the fork 6 and the input signals at the input terminals $T_1$–$T_3$. The data D1 includes combinations of high (H) and low (L) signals from the input terminals $T_1$–$T_3$, in accordance with the three height zones of the forklift 6 (low zone, middle zone, high zone). When the fork 6 and the inner masts 3*b* are in the low zone, the levers 8 of both sensors 7 are engaged and pivoted by the inner masts 3*b.* This disengages the detection plates 8*b* of the sensors 7 from the detection members 10*a* and connects the terminals 20 of the switches $SW_1$, $SW_2$ to a first contact point 21*a.* As a result, the combination of the signals from the input terminals $T_1$–$T_3$ is low, high, high, respectively. When the fork 6 and the inner masts 3b are in the middle zone, only the lever 8 of the lower sensor 7 is disengaged from the inner mast 3*b,* and the detection plate 8*b* is connected to the detection portion 10*a.* This connects the terminal 20 of the lower switch $SW_1$ to the second contact point 21*b* and connects the terminal 20 of the upper switch $SW_2$ to the first contact point 21*b.* As a result, the combination of the signals from the input terminals $T_1$–$T_3$ is high, low, high, respectively. When the fork 6 and the inner masts 3*b* are in the high zone, the levers 8 of both sensors 7 are disengaged from the associated inner mast 3*b.* This connects the terminals 20 of the switches $SW_1$, $SW_2$ to the second contact points 21*b.* As a result, the combination of the signals from the input terminals $T_1$–$T_3$ is high, high, low, respectively.

The CPU 13 controls the forklift in accordance with the height of the fork 6. However, the CPU 13 judges which zone (low, middle, and high) the fork 6 is in by reference to the data D1 . When the combination of the signals does not correspond to any of the data D1, the CPU 13 judges that there is a cut wire or a short circuit in the electrical system of the position detector.

When the signal line $SL_1$ of the first input terminal is cut, the signal at the first input terminal $T_1$ is continuously high since the first signal line $SL_1$ is not grounded. Accordingly, when the fork 6 is in the low zone, the combination of the signals from the input terminals $T_1$–$T_3$ is high, high, high. Then, the CPU 13 judges that there is an abnormality. When the first signal line $SL_1$ is short-circuited, that is, when the first signal line $SL_1$ is cut and connected to the mast 3, the potential at the first input terminal $T_1$ is continuously low. Accordingly, when the fork 6 is in the middle or high zones, the combination of signals from the input terminals $T_1$–$T_3$ is low, low, high or low, high, low. Then, the CPU 13 judges that there is an abnormality. In this way, it is detected if the first signal line $SL_1$ is cut or short-circuited.

Likewise, when the first and second signal lines $SL_1$, $SL_2$ are both cut or short-circuited, an abnormality is detected. When the connecting line L is cut, the signals from the input terminals $T_1$, $T_2$ are always high. This condition is not in the data D1 when the fork 6 is at the middle or high position. Thus, the CPU 13 finds the abnormality. When the connecting line L is short-circuited, the signals of the input terminals $T_1$, $T_2$ are low or high in accordance with the state of the upper switch $SW_2$. This is also not in the data D1 when the fork 6 is at the low position. Therefore, the CPU 13 judges that there is an abnormality. When the switches SW, $SW_2$ are in disorder, the combination of the signals are not in the data D1 and the abnormality causing the disorder is detected.

The CPU 13 controls the vehicle in accordance with the height of the fork 6. However, when the CPU judges that there is an abnormality, the fork 6 is judged to be in the high zone regardless of its actual position. When the fork is at the highest position, the center of gravity of the vehicle is high, and the rear axle is restricted to stabilize the vehicle. Until a signal reporting correction of the disorder is input, the CPU 13 controls the vehicle as if the fork 6 is at the high position. The CPU 13 activates a reporting device 25 located in the driver's compartment to notify the driver that there is an abnormality. For example, a buzzer or a warning lamp is used as the reporting device 25.

The present embodiment has the following advantages.

(1) The height of fork 6 is detected with reference to the predetermined data D1 by the combination of signals at each input terminal $T_1$–$T_3$, which varies with the state of the switches $SW_1$, $SW_2$. When the combination of the signals does not correspond to the data D1, it is judged that there is an abnormality. Therefore, detection of the height of the fork 6 is ensured and a cut or a short-circuited wire at any portion of the signal lines $SL_1$, to $SL_3$ or the connecting line L is quickly detected. Malfunctions of the switches $SW_1$, $SW_2$ are also detected in the same way. Accordingly, substantially all the disorders in the electrical system of the position detector are detected.

(2) The second contact point 21*b* of the lower switch $SW_1$, is connected to the terminal 20 of the upper switch $SW_2$ by the connecting line L. Therefore, each of the three positions has a different combination of signals. Further, the number of signal lines is three, which is larger than the number of the switches $SW_1$, $SW_2$ by one. Accordingly, the number of signal lines is reduced as much as possible and the number of input terminals to the controller 11 is also reduced. As a result, the likelihood of a cut wire or a short-circuit is reduced. The connecting line L is necessary for connecting the switch $SW_1$, and the switch $SW_2$, but the length of the connecting line L need only extend between the switches $SW_1$, and $SW_2$.

(3) The terminal 20 of the switch $SW_1$, is grounded to the outer mast 3*a,* thus the terminal 20 has a ground potential. Therefore, there is no need for wiring from a power source like batteries to the switch $SW_1$.

The present invention will further be embodied as follows.

Instead of detecting three positions of the fork 6 by two switches 10, more than four positions may be detected by more than three switches 10. For example, in the second embodiment shown in FIG. 6, (n+1) positions are detected by n ($n \geqq 3$) switches $SW_1$–$SW_n$.

The terminal 20 of the lowest switch $SW_1$, in the lowest sensor 7 is grounded to the outer mast 3*a,* the first contact point 21*a* is connected to the input terminal $T_1$ of the controller 11, and the second contact point 21*b* is connected to the terminal 20 of the consecutively higher switch $SW_2$. This series-style connection also applies to $SW_2$ to $SW_n$. The first contact point 21*a* is connected to the input terminals $T_1T_n$ of the controller 11, and the second contact point 21*b* is connected to the terminal 20 of the consecutively higher switch. In the highest switch $SW_n$ of the uppermost sensor 7, the second contact point 21b is connected to the input terminal $T_{n+1}$ of the controller 11.

Accordingly, the number of the signal lines for connecting n switches $SW_1$–$SW_2$ to the controller 11 is n+1. The total length of the connecting lines $L_1$–$L_{n-1}$, which connect each switch $SW_1$–$SW_n$, is substantially the same as that of the outer mast 3*a*. The number of input terminals for the controller 11 is n+1.

The memory 14 stores the data D2 shown in FIG. 7. In the data D2, (n+1) height zones $R_1$–$R_{n+1}$, which are obtained by dividing the moving range of the fork 6 by (n+1), are set. The combinations of signals corresponding to each height $R_1$–$R_{n+1}$ are set. The combinations of the signals from the input terminals $T_1$–$T_n$ are all different in accordance with the zones $R_1$–$R_{n+1}$. For example, in the height $R_n$, which is nth from the bottom, the signal applied to the input terminal $T_n$ is low (L), and the other signals at the other input terminals are all high (H).

Like the first embodiment, when the combination of signals from the input terminals $T_1$–$T_n$ is not in the data D2, abnormalities, like cut or short-circuited signal lines $SL_1$–$SL_{n+1}$ or connecting lines $L_1$–$L_{n-1}$, are detected. Further, malfunctions of the switches $SW_1$–$SW_n$ are also detected.

Figures 8, 9:
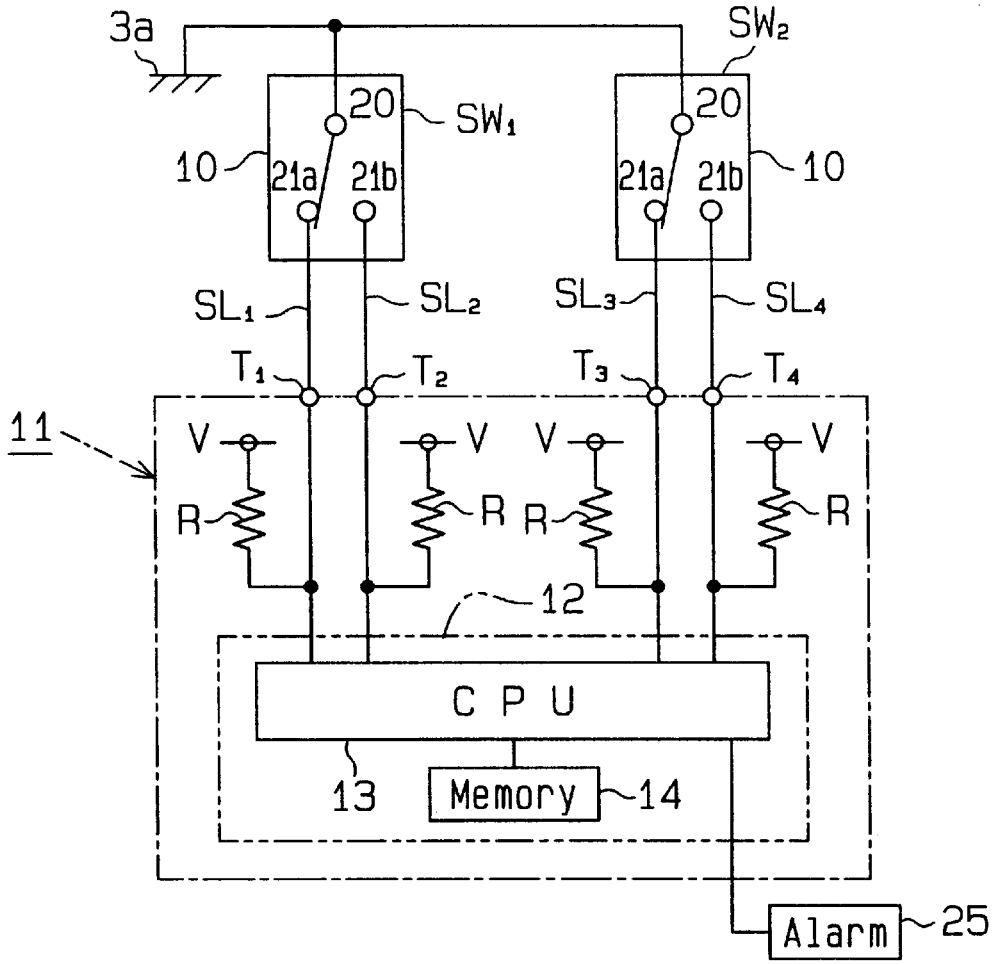
FIG. 8 shows an electric circuit of a detector according to a third embodiment of the present invention.
FIG. 9 is a data table showing the relationship between the fork height and the combination of signals to a controller.

In a third embodiment shown in FIG. 8, the first contact point 21*a* and the second contact point 21*b* may be connected to the input terminals $T_1$–$T_4$ of the controller 11 by corresponding signal lines $SL_1$–$SL_4$. The terminal 20 of each switch 10 is grounded to the outer mast 3*a*. The memory 14 stores the data D3 shown in FIG. 9. The combinations of signals under normal conditions are represented by the data D3. The CPU 13 judges the zone to which the height of the fork 6 belongs in reference to data D3 by the combination of signals from the input terminals $T_1$–$T_4$. When the combination of the signals from input terminals $T_1$–$T_4$ is not in the data D3, the CPU 13 judges that there is an abnormality.

Like the first and second embodiments, a cut or a short-circuit in any signal line $SL_1$–$SL_4$ or a malfunction of any of the switches $SW_1$, $SW_2$ will be detected. FIG. 8 shows two switches 10, however, more than three switches may be used.

Further, two positions may be detected by one switch.

The position detector of the present invention is not limited to detecting the height of a fork. The present invention may be used to detect other position parameters. For example, the present invention may be used to detect the inclination angle of the mast 3 or the reach of fork 6 using incremental zones. The position detector of the present invention may be configured to measure rotational movement.

The height sensor 7 may simply be a switch without the lever 8 and the housing 7*a*. In this case, a cover is preferably provided for protection.

The switches 10 are not limited to the contact point type, they may also be a non-contact point type. Non-contact point type switches have a similar performance.

Figure 6:
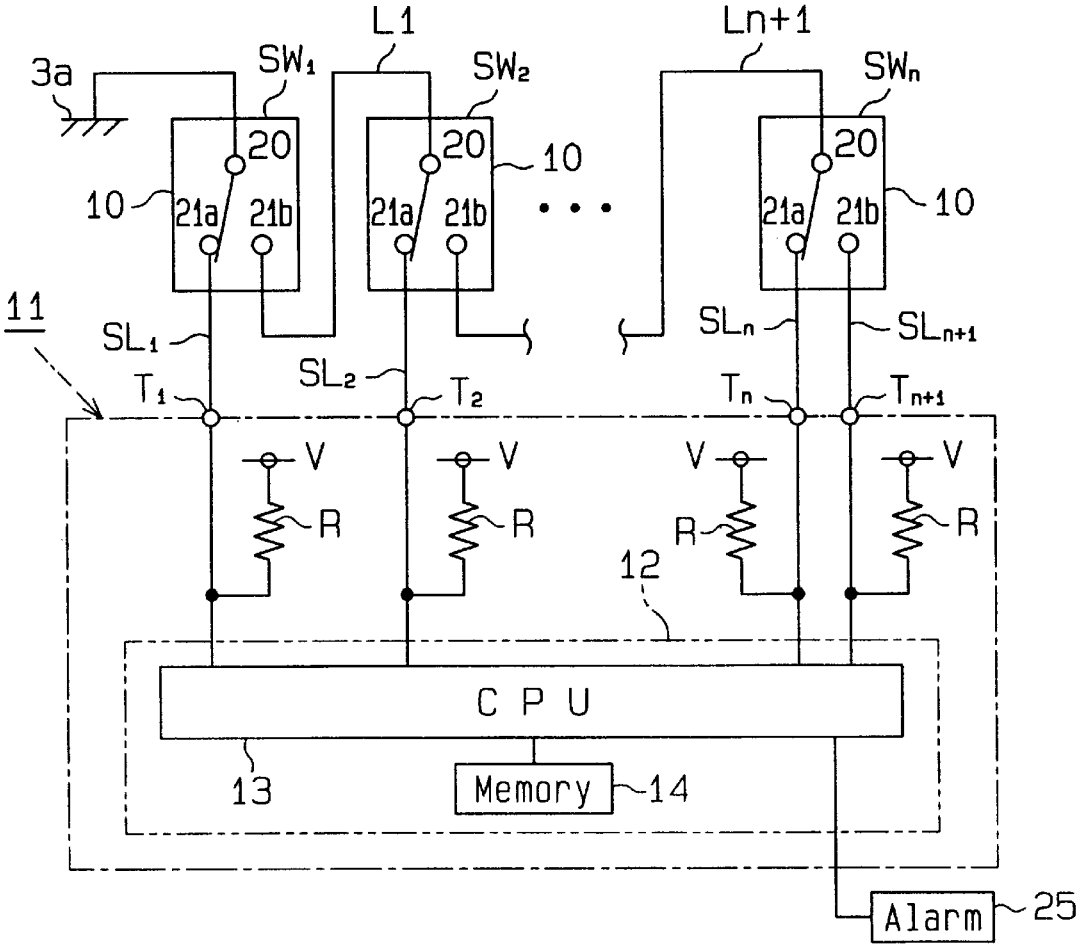
FIG. 6 shows an electric circuit of a detector according to a second embodiment of the present invention.

The arrangement of the switches 10 to the mast 3 is not limited to that shown in the FIGS. 1 and 6. In other words, the switch having a grounded terminal 20 may be located at the highest position of the mast 3, and the other switches may be consecutively arranged below it along the mast 3. In this case, the same data in FIGS. 2, 7, 9 can be used by arranging the detection plates 8*b* to depress the associated switch 10 when the lever 8 of the sensor 7 pivots clockwise, which is opposite to the arrangement of FIG. 4.

The terminal 20 of the lower switch $SW_1$, does not have to be grounded. The first terminal may be wired to a power source, and plus or minus potential may be applied to the terminal 20 of the lower switch $SW_1$.

The present invention may be applied to industrial vehicles other than the forklift 1, such as shovel loader, backhoe, and high elevation vehicle.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. An apparatus for detecting the position of a movable body provided on an industrial vehicle, wherein the movable body moves on a predetermined path, and the apparatus detects the passage of the movable body on the path, the apparatus comprising:

a switch or a plurality of switches, each switch having two states, wherein each switch is associated with a location on the path, and passage of the movable body by the location changes the state of the associated switch;

a position judging means having a plurality of input terminals, the number of the plurality of input terminals being more than the number of switches by at least one, wherein each switch is connected to at least one of the plurality of input terminals, and each of the plurality of input terminals is associated with the switch or one of the switches, wherein signals at the input terminals have two states in accordance with the state of the associated switch, the judging means including position judging data, wherein a relationship between zones of movement of the movable body and combinations of signal states at the input terminals is defined by the data, wherein the judging means judges that the position of the movable body is within one of the zones in accordance with the data when the combination of the signals at the input terminal exists in the data, and the judging means judges that there is an abnormality when the combination of signals at the input terminal does not exist in the judging data.

2. The apparatus according to claim 1, wherein the industrial vehicle is a forklift, the forklift including a mast, wherein the movable body is supported by the mast to ascend and descend, wherein the switch is or the switches are provided on the mast.

3. The apparatus according to claim 1, wherein the number of switches is two or more, one of the switches being a first switch, one of the switches being a last switch, each switch including one switch terminal, and first and second contact points, the first and second contacts points being selectively connected to their associated switch terminal in accordance with the position of the movable body, wherein the switch terminal of the first switch has a predetermined potential, and each second contact point, except for that of the last switch, is electrically connected to the switch terminal of an adjacent one of the switches, each first contact point being connected to a corresponding one of the plurality of input terminals, wherein the second contact point of the last switch is connected to a corresponding one of the input terminals.

4. The apparatus according to claim 3, wherein the industrial vehicle is a forklift, the forklift including a mast, wherein the movable body is supported by the mast to ascend and descend, wherein the switches are arranged consecutively along the mast, and the states of the switches are changed in accordance with the position of the movable body.

5. The apparatus according to claim 3, wherein the switch terminal of the first switch is grounded and a voltage is applied to each input terminal.

6. An apparatus for detecting the position of a movable body provided on an industrial vehicle, wherein the movable body moves on a predetermined path, the path being divided into a plurality of zones and the apparatus detects the passage of the movable body from one zone to another, the apparatus comprising:

a plurality of switches arranged in a consecutive order from a first to a last of the switches along the path of the movable body, the states of the switches being changed between two states in accordance with the position of the movable body, each switch including a switch terminal and first and second contact points, the contact points being selectively connected to the switch terminal in accordance with the position of the movable body, wherein a predetermined potential is applied to the switch terminal of a first one of the switches, and each second contact point, except for that of a last one of the switches, is electrically connected to the switch terminal of an adjacent one of the switches; and a position judging means including a plurality of input terminals, the number of the plurality of input terminals being one more than the number of switches, wherein the first contact points of the switches are connected to corresponding ones of the plurality of input terminals, and the second contact point of the last switch is connected to a corresponding one of the input terminals, and there are two voltage levels at each input terminal, wherein the judging means judges which of a plurality of zones the movable body is in based on the combination of the voltage levels of the plurality of input terminals.

7. The apparatus according to claim 6, wherein the judging means includes a storage means for storing position judging data, wherein a relationship between the zones and the combination of voltage levels of the input terminals is defined by the data, and the judging means determines that the movable body is in one of the zones when the combination of the voltage levels at the input terminals exists in the data, and the judging means judges that there is an abnormality when the combination of the voltage levels does not exist in the data.

* * * * *

UNITED STATES PATENT AND TRADEMARK OFFICE

CERTIFICATE OF CORRECTION

PATENT NO. : 6,138,795
DATED : October 31, 2000
INVENTOR(S) : Toshikazu Kamiya

It is certified that error appears in the above-identified patent and that said Letters Patent is hereby corrected as shown below:

Title page,
Item [54] title, please change:
"POSITION DETECTOR FOR INDUSTRIAL VEHICLES" to
-- MALFUNCTION DETECTOR OF POSITION SENSOR FOR INDUSTRIAL VEHICLES --;

Column 5,
Line 50, please change "$SL_1$," to -- $SL_1$ --;
Line 55, please change "$SW_1$," to $SW_1$ --;
Line 65, please change "$SW_1$," to $SW_1$ --;

Column 6,
Line 13, please change "$SW_1$," to $SW_1$ --;
Line 20, please change "$T_1$ $T_n$" to -- $T_1$-$T_n$ --;

Column 7,
Line 21, please change "$SW_1$," to $SW_1$ --;

Column 8,
Line 5, please change "contacts" to -- contact --.

Signed and Sealed this

Twelfth Day of March, 2002

*Attest:*

*Attesting Officer*

JAMES E. ROGAN
*Director of the United States Patent and Trademark Office*